United States Patent [19]

Tolmie, Jr. et al.

[11] Patent Number: 4,953,842

[45] Date of Patent: Sep. 4, 1990

[54] MAIL THICKNESS MEASURING APPARATUS

[75] Inventors: Robert J. Tolmie, Jr., Brookfield; Donald T. Dolan, Ridgefield, both of Conn.

[73] Assignee: Pitney Bowes Inc., Stamford, Conn.

[21] Appl. No.: 291,038

[22] Filed: Dec. 28, 1988

[51] Int. Cl.[5] ..... B65H 3/04

[52] U.S. Cl. ..... 271/2; 271/35; 271/263; 271/270

[58] Field of Search ..... 271/263, 270, 2, 122, 271/35

[56] References Cited

U.S. PATENT DOCUMENTS

| | | | |
|---|---|---|---|
| 3,244,971 | 4/1966 | Thompson | 271/263 X |
| 3,339,917 | 9/1967 | Petrovsky | 271/122 |
| 3,373,685 | 3/1968 | Adams | 271/263 X |
| 3,768,094 | 10/1973 | Henrich . | |
| 3,878,025 | 4/1975 | Storace et al. . | |
| 3,937,453 | 2/1976 | Hickey | 271/263 X |
| 3,944,211 | 3/1976 | Rasmussen | 271/122 X |
| 4,127,266 | 11/1978 | Williams | 271/263 |
| 4,171,130 | 10/1979 | Jeschke et al. . | |
| 4,361,835 | 10/1982 | Nagy . | |
| 4,378,109 | 3/1983 | Takahashi | 271/263 |
| 4,518,918 | 5/1985 | Avery . | |
| 4,540,887 | 9/1985 | Minerd et al. . | |
| 4,559,452 | 12/1985 | Igaki et al. . | |
| 4,599,561 | 7/1986 | Takahashi et al. . | |
| 4,671,502 | 6/1987 | Sherman, III et al. . | |
| 4,687,106 | 8/1987 | Prins . | |
| 4,691,912 | 9/1987 | Gillmann . | |

*Primary Examiner*—Richard A. Schacher

*Attorney, Agent, or Firm*—Charles G. Parks, Jr.; David E. Pitchenik; Melvin J. Scolnick

[57] ABSTRACT

In a mail handling machine, mail thickness measuring apparatus associated with a singulator mechanism for measuring mail thickness as soon as individual mail pieces are separated by the singulator from a stack of mail pieces.

7 Claims, 3 Drawing Sheets

FIG. 2.

| Position | Range in mm | Detector Number 10 | 11 | 12 | 13 | 14 | 15 | 16 | Hex Output |
|---|---|---|---|---|---|---|---|---|---|
| | | Binary Output | | | | | | | |
| 0 | 0 - .050 | 0 | 0 | 0 | 1 | 1 | 1 | 1 | 0 F |
| 1 | .05 - .1 | 0 | 1 | 0 | 1 | 1 | 1 | 1 | 2 F |
| 2 | .1 - .15 | 1 | 1 | 0 | 1 | 1 | 1 | 1 | 6 F |
| 3 | .25 - .2 | 1 | 0 | 0 | 1 | 1 | 1 | 1 | 4 F |
| 4 | .2 - .25 | 1 | 0 | 0 | 0 | 1 | 1 | 1 | 4 7 |
| 5 | .25 - .3 | 1 | 0 | 1 | 0 | 1 | 1 | 1 | 5 7 |
| 6 | .3 - .35 | 1 | 1 | 1 | 0 | 1 | 1 | 1 | 7 7 |
| 7 | .35 - .4 | 1 | 1 | 0 | 0 | 1 | 1 | 1 | 6 7 |
| 8 | .4 - .45 | 1 | 1 | 0 | 0 | 0 | 1 | 1 | 6 3 |
| 9 | .45 - .5 | 1 | 1 | 0 | 1 | 0 | 1 | 1 | 6 B |
| 10 | .5 - .55 | 1 | 1 | 1 | 1 | 0 | 1 | 1 | 7 B |
| 11 | .55 - .6 | 1 | 1 | 1 | 0 | 0 | 1 | 1 | 7 3 |
| 12 | .6 - .65 | 1 | 1 | 1 | 0 | 0 | 0 | 1 | 7 1 |
| 13 | .65 - .7 | 1 | 1 | 1 | 0 | 1 | 0 | 1 | 7 5 |
| 14 | .7 - .75 | 1 | 1 | 1 | 1 | 1 | 0 | 1 | 7 D |
| 15 | .75 - .8 | 1 | 1 | 1 | 1 | 0 | 0 | 1 | 7 9 |
| 16 | .8 - .85 | 1 | 1 | 1 | 1 | 0 | 0 | 0 | 7 8 |
| 17 | .85 - .9 | 1 | 1 | 1 | 1 | 0 | 1 | 0 | 7 A |
| 18 | .9 - .95 | 1 | 1 | 1 | 1 | 1 | 1 | 0 | 7 E |
| 19 | .95 - 1.0 | 1 | 1 | 1 | 1 | 1 | 0 | 0 | 7 C |
| | | MSB | | | | | | LSB | |

MAIL THICKNESS MEASURING APPARATUS

REFERENCE TO RELATED APPLICATIONS

U.S. patent application Ser. No. 291,094, filed Dec. 28, 1988, which describes measuring sensors producing digital outputs that are absolute Gray encoded.

U.S. patent application Ser. No. 291,098 filed Dec. 28, 1988, which describes apparatus for separating single mail pieces from stacked mail.

U.S. patent application Ser. No. 291,483, filed Dec. 28, 1988, which describes a high speed mailing machine providing different velocity profiles for processing mail of different weight.

FIELD OF THE INVENTION

This invention relates to mail thickness measuring apparatus, and in particular to such apparatus for use in high speed mail handling machine.

BACKGROUND OF THE INVENTION

State-of-the-art mailing machines can perform such automatic functions as handling mail of different sizes and thicknesses, envelope sealing, mail weighing, mail stamping, and mail sorting. In developing machines with such functions, capable of processing mail at high speeds of, for example, four or more pieces per second, it becomes important if not essential that the mail thickness is determined as soon as possible after the mail begins its flow sequence. Knowing the thickness early is important because there usually is a relationship between mail thickness and mail weight, i.e., the thicker the mail, the more it weighs. Typically, heavier mail must be processed slower than lighter mail in a high speed processing environment. Hence, the weight of the mail allows the computer which is controlling the machine to slow the transport mechanisms when carrying heavy mail and speed up the transport mechanisms when carrying lighter mail.

It is desirable to control transport velocity as a function of mail weight or mail thickness as soon as the mail pieces begin their flow through the machine. Typically, the mail pieces enter the system from a hopper is stacked form, and one of the first actions necessary is to separate an individual piece of mail from the stack. The mehanism for doing this is called a singulator and the action singulating. The copending application Ser. No. 291,098, describes one form of singulator mechanism for use in a high speed mailing machine, the contents of which application are herein incorporated by reference.

Mail thickness sensors in prior art machines would typically position on top of the mail piece a follower connected to an optical system involving a light source scanning across an array of light detectors, the position of the light source being determined by the position of the follower, and the position of the light source determining which detector is activated. Mechanical systems have also been used.

These prior art systems suffer from one or more of the following shortcomings. With optical systems, frequent maintenance is necessary to keep the optics clean. A mailing machine processing thousands of pieces of mail daily does not provide a clean environment for optical sensors. The signal output frequently was analog. This meant the use of an A/D converter to translate the analog signal into a digital signal that the computer can process, which increased costs. Accuracy of thickness measurement was not always optimal. Especially with high speed processing, it is important to be able to measure the mail thickness in the range of 0.004–0.75 inches to an accuracy of about 0.05 inches.

SUMMARY OF THE INVENTION

One object of the invention is mail thickness measuring apparatus capable of measuring the thickness of mail pieces being processed at high speeds.

Another object of the invention is a mail handling machine for processing mail pieces of different thicknesses at high speeds wherein the thickness measurement is carrried out early in the mail flow.

A further object of the invention is thickness and measuring apparatus for mail pieces that is capable of accurately measuring the mail piece thickness while the mail piece is being processed at high speed.

In accordance with one aspect of the invention, in a mailing machine capable of processing at high speed mail pieces supplied from a stack, mail thickness measuring apparatus is provided coupled to the singulator device that separates individual mail pieces from the stack. By coordinating the thickness measuring function with the singulating function, the thickness of the mail pieces is determined as soon as the flow of individual mail pieces begins and thus the velocity of that flow can be computer-controlled for maximum efficiency and speed.

In accordance with another aspect of the invention, the thickness measuring apparatus comprises a permanent magnet and a magnetic field detector system. This allows the system to operate accurately in a unclean environment, since the presence of dirt or contamination has virtually no effect on the magnetic field.

In accordance with still another aspect of the invention, a relatively simple but accurate thickness measurement system is employed, which outputs an absolute encoded digital value which can be directly processed by a computer to control the velocity of the measured mail piece as it flows through the machine for subsequent sealing, weighing, stamping, and sorting if desired. In a preferred embodiment, connected to a follower which contacts the mail piece top is a permanent magnet having plural poled segments, the magnet position tracking that of the follower. The magnet traverses an array of magnetic field detectors which respond to selected detected magnetic fields, and in reponse outputs an absolute Gray encoded binary number which is unique for each subrange of mail thickness. Twenty accurate thickness measurements can be made over a range of 0.004–0.75 inches to an accuracy of 0.05 inches. The resultant binary number can then be used to index into a lookup table for selecting an appropriate flow velocity sequence or profile for the measured mail piece in its subsequent processing through an automatic mail handling machine.

DESCRIPTION OF DRAWINGS

The invention will now be described in greater detail with respect to several exemplary embodiments in connection with the accompanying drawing, wherein:

FIG. 2 is a table showing the binary coded and hex output for the sensor of FIG. 1;

In the several figures, the same reference numerals are employed to designate similar elements.

Figure 1:
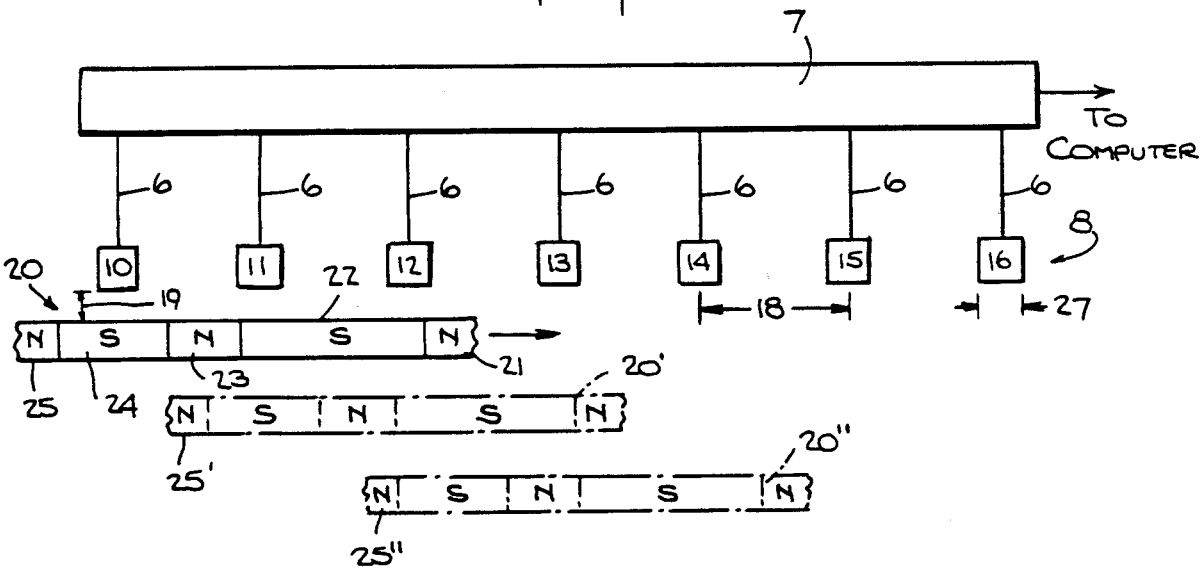
FIG. 1 is a schematic view of one form of magnetic sensor suitable for measuring mail thickness in accordance with the invention.

A suitable mail thickness sensor suitable for use in a mail-handling machine has already been described in great detail in the copending application Ser. No. 291,094, whose contents are hereby incorporated by reference, but for convenience the embodiment preferred for measuring mail or letter thickness which is schematically illustrated in FIG. 1 will be briefly described below. The sensor assembly companies a fixed detector assembly 8, and a moving magnet 20. The fixed detector assembly comprises seven Hall effect detectors 10–16 arranged in a row spaced apart by a fixed center-to-center spacing 18. Each detector has an active detecting area indicated by reference numeral 27.

The magnet 20 moves in a straight line parallel to the detector row separated by a gap 19. The preferred magnetic array comprises two South (S) poles 22,24 separated by a North (N) pole 23. Additional N poles can be provided at the leading edge, pole 21, and at the trailing-edge, pole 25, of the assembly to sharpen the field transitions. The magnet is moved by the mail piece follower in the direction indicated by the arrow. The position of the magnet 20 shown in solid lines is the start or zero thickness position. In dashed lines are shown magnet positions 20′ and 20″ in which the magnet would have been moved four and nine units, respectively, to the right of its starting position.

For the preferred geometry shown, with the active detector area 27 equal to 0.05 inches, the detector spacing 18 equal to 0.2 inches (in the arrow direction), S pole 22 0.025 inches long, N pole 23 0.1 inches long, and S pole 24 0.15 inches long, the detector array will output twenty different absolute Gray codes over a mail thickness range of 0.004 to 1.0 inches with a worst case resolution of ±0.05 inches. The output binary code can be stored in a register 7, and subsequently retrieved by a computer to be processed.

FIG. 2 is a table showing the output from each detector in response to positions of the magnet 20. Basically, the detector outputs a "0" when opposite a S pole, and a "1" when opposite no field or a N pole. The columnn on the right, the Hex equivalent of the adjacent binary coded output, shows that the output is absolute, meaning no two codes are alike. The binary outputs demonstrate Gray encoding, since no more than one bit changes for adjacent magnet positions. The magnet is readily manufactured in the geometry shown, and the detectors are commercially available as inexpensive Hall-effect detectors. The gap spacing 19 would be typically 0.04 inches. Reference is made to said copending application Ser. No 291,094, for further details of the operation of this magnetic detector system. As previously mentioned, since the moving part of the sensor is a magnet, and the fixed part the Hall-effect detectors, a rugged sensor is obtained that will withstand much abuse. Since magnetic fields are sensed, the system is virtually immune to dirt and contamination. The direct output of a binary-coded number eliminates the need for analog-to-digital conversion and reduces costs. The Gray encoding ensures high resolution, reliable measurements.

In a practical embodiment, the detectors 10–16 are mounted in a common holder or on a common support, with a seven wire connector 6 for the output to the register 7.

Figure 3:
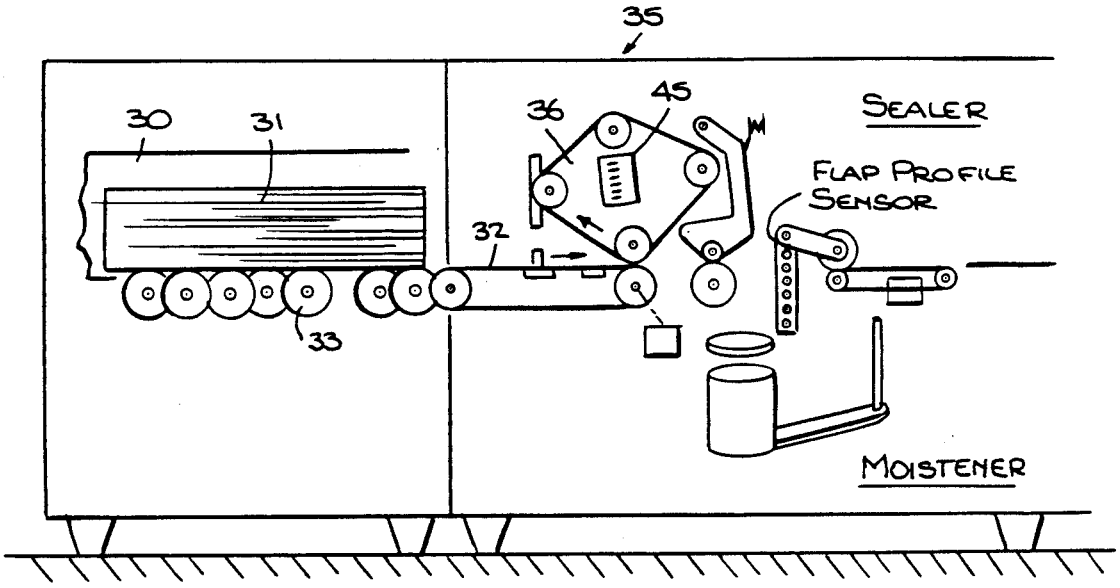
FIG. 3 is a front schematic view of a typical mail handling machine employing the sensor of FIG. 1.

FIG. 3 illustrates schematically the front end of the mail handling machine, comprising a hopper 30 for receiving a stack of mail pieces 31 for processing. A transport system comprising motor driven rollers 32 and a belt 33 picks out one or more of the mail pieces 31 from the stack bottom and immediately carries them under a singulator mechanism 35 which functions to ensure that only a single piece of mail will thereafter be processed at a time by the machine.

Figure 4:
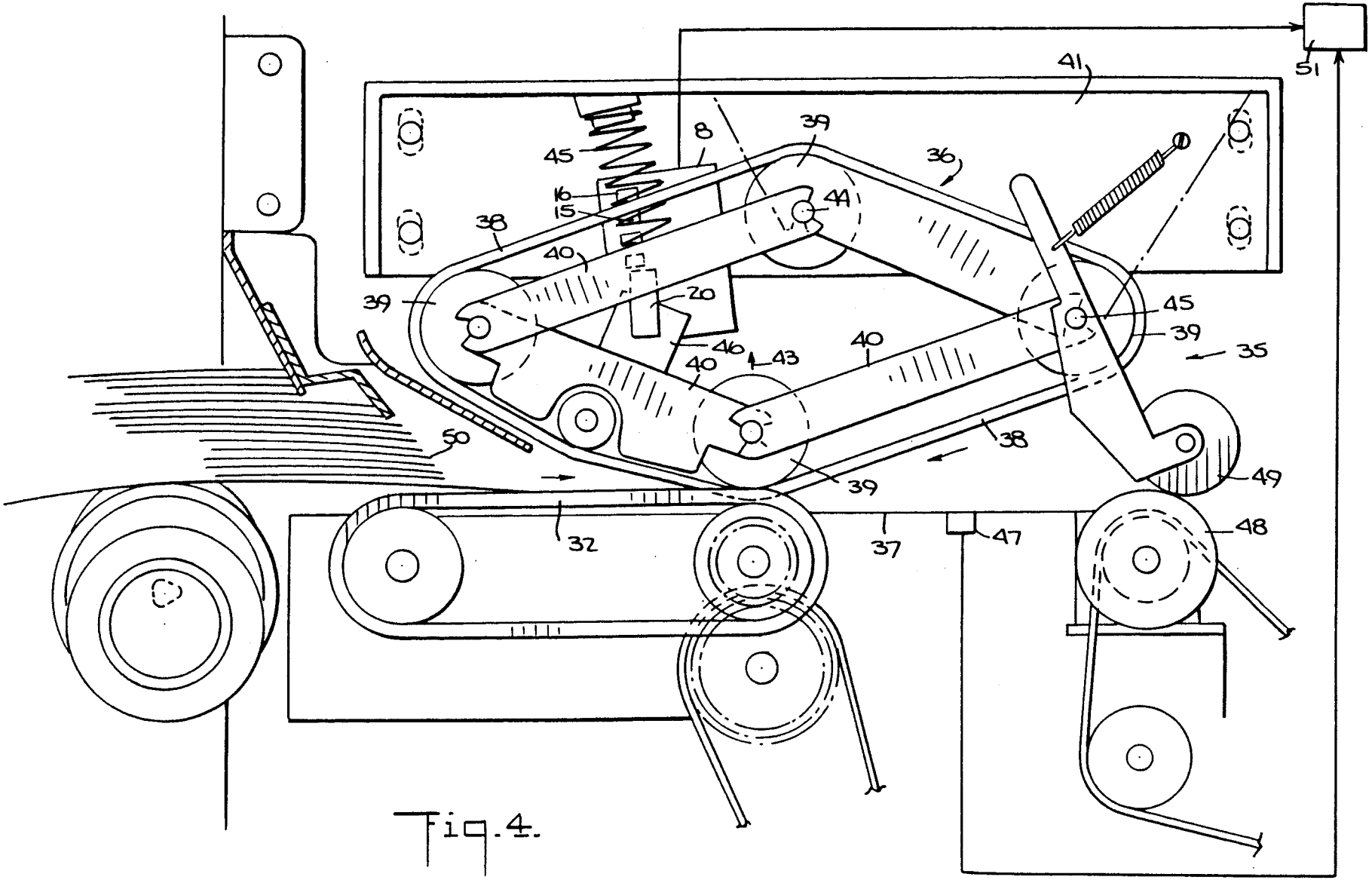
FIG. 4 is a detailed side view of the singulator and magnetic sensor schematically depicted in FIG. 3.

The singulator 35 may comprise any one of a number of known mechanisms, provided that it includes a movable element that follows the mail piece top. A preferred singulator, which is described in detail in the copending application Ser. No. 291,098 comprises a four-bar linkage mechanism 36 which is pivoted on the machine frame. A more detailed illustration is shown in FIG. 4. The forward drive for the mail pieces, shown at 50, is supplied by the belt or belts 32 which is mounted on the machine deck 37. The four-bar linkage 36 comprises one or more reversely-driven belts 38 rotating around pulleys 39 located at the corners of a rhombus formed by the linkages 40. The rhombus is anchored at pulley shafts 44 for pivotable movement on a support 41 extending up from the machine frame. A compression spring 45 biases the singulator 36 downward and applies a load onto the mail which it is helping to singulate. The reversely-driven belts 38 are typically interdigitated with the forward driving belts 32.

In operation, if more than one mail piece or overlapped mail pieces enter the zone between the reversely-driven belts 38 and the forwardly-driven belts 32, while the bottom mail pieces is driven forward to the right, any overlapping mail pieces are driven backward. In this process, the bottom mail piece is driven under the singulator nip, the lowermost portion of the reversely-driven belts 38, causing an upwards push on the mechanism. The rhombus 36 deforms to allow mail pieces of varying thickness to pass under it while maintaining its outer circumference. Thus, the rhombus 36 acts as a follower that moves upward in the direction indicated by arrow 43 a distance proportional to the mail thickness. The magnet array 20 depicted in FIG. 1, which is fixed by plate 46 to the lower linkage bar 40, likewise moves upward the same proportional distance. The Hall-effect detector array 8 for the magnet array 20 is mounted on a printed circuit board, which in turn is mounted on the fixed suppport 41. An optical sensor 47 is mounted in the deck 37 and functions to detect the leading edge of the mail piece. When detected, the sensor shuts down the forward and reverse drives for an instant. Thus, the singulator upward motion stops. At that point, the detector output to the register 7 stabilizes, and the computer, shown at 51, also signalled by the sensor 47, polls the register 7, retrieves the binary coded number stored therein, and in turn stores it in an internal register. After a fixed time delay, typically 20 ms, the drive mechanisms are restarted and the mail piece is carried forward, to the right, and is captured by a takeway nip formed by driven roller 48 and springbiased idler 49, affixed to shaft 45, and is thus carried downstream for further processing. If desired, a second sensor (not shown) can be positioned downstream of the sensor 47 which would operate similarly, i.e., detect the leading envelope edge, stop the drives, and then restart them, all under computer control. This would allow a second mail thickness measurement to be made of the same mail piece, and the second measurement averaged with the first to ensure that unevenly stuffed envelopes do not produce an erroneous weight indication.

As will be noted from the foregoing description, by associating the thickness measuring sensor with a singulator mechanism that follows mail pieces of varying thickness, the thickness measurement is taken nearly simultaneously with the singlulating action, and thus early on in the mail handling process. Thus, the computer is informed of the mail thickness and thus approximate weight at virtually the same time that each mail piece begins its serial processing through the machine.

The use of the magnetic field operating sensors ensures trouble free reliable operation even in the environment of high mail throughput machines. Moreover, obtaining a binary coded output directly reduces costs, and when the output is Gray encoded increases accuracy. The mechanism described, as illustrated in the drawings, provides accuracy to 0.05 inches of the mail thickness. As discussed in the copending application, the resolution and range of measurable thicknesses can be varied by adjusting the geometry of the detector array and magnetic configuration or through the use of linkages between the singulator and the magnet.

It will be understood that the invention is not limited to the specific configuration of thickness sensor disclosed, and other configurations as described in the above-mentioned copending application will also prove suitable. Moreover, the inventions is not limited to the singulator mechanism specifically disclosed, nor to the other details of the preferred embodiment described.

While the invention has been described and illustrated in connection with preferred embodiment, many variations and modifications as will be evident to those skilled in the art may be made therein without departing from the spirit of the invention, and the invention as set forth in the appended claims is thus not to be limited to the precise details of construction set forth above as such variations and modifications are intended to be included within the scope of the appended claims.

What is claimed is:

1. Apparatus for measuring the thickness of mail pieces, comprising means for generating a magnetic field pattern, an array of magnetic field detectors for outputting a binary signal in response to the field pattern, said field generating means and detectors being configured such that the outputted binary signal is absolute and Gray encoded over a range of thicknesses of the mail, means for contacting the mail and movable in response to the thickness of the contacted mail, and means connecting the contacting means and generating means for moving the latter past the array over the distance proportional to the movement of the contacting means, the field generating means being a magnet having plural poles arranged in a row a first pole segment, a second pole segment, and a third pole segment of the same type as the first pole, the three segments having differing lengths, the magnetic field detectors being equally spaced apart.

2. Apparatus as claimed in claim 1 wherein the detector array comprises Hall-effect detectors.

3. Apparatus for processing mail pieces comprising means for supplying multiple mail pieces, a singulator for separating individual mail pieces, means for transporting mail pieces from the supplying means to the singulator, means operatively connected to the singulator for measuring the thickness of mail pieces singulated thereby and means downstream of the singulator for further processing of the mail, further transporting means for tranporting the single mail pieces to the further processing means, and means for varying the velocity of the further transporting means in accordance with the measured thickness of each mail piece processed.

4. Apparatus as set forth in claim 3 wherein the singulator comprises a movable member for contacting the surface of a mail piece and means for mounting the singulator for movement in a direction transvere to the mail piece movement direction in response to the mail piece thickness, said thickness measuring means comprising a part connected to and movable with the singulator and a fixed part, the measured thickness being related to the relative amount of movement between said moving and fixed parts.

5. Apparatus as set forth in claim 4 wherein the said moving part comprises a magnet, and the said fixed part comprises a magnetic field detector.

6. Apparatus as claimed in claim 3 further comprising means for temporarily stopping the mail piece when it is under singulator.

7. Apparatus as claimed in claim 4, further comprising means for moving the movable member where it contacts the mail piece surface in a direction generally reversed with respect to a singulated mail piece.

* * * * *